US008540333B2

(12) United States Patent
Komuro et al.

(10) Patent No.: US 8,540,333 B2
(45) Date of Patent: Sep. 24, 2013

(54) RECORDING APPARATUS

(75) Inventors: Shintaro Komuro, Shiojiri (JP); Kazuhisa Nakamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 626 days.

(21) Appl. No.: 12/538,697

(22) Filed: Aug. 10, 2009

(65) Prior Publication Data

US 2010/0033528 A1 Feb. 11, 2010

(30) Foreign Application Priority Data

Aug. 11, 2008 (JP) ..... 2008-207263

(51) Int. Cl.
*B41J 29/38* (2006.01)
*B41J 3/407* (2006.01)

(52) U.S. Cl.
CPC ..... *B41J 3/4071* (2013.01)
USPC ..... 347/16; 347/2

(58) Field of Classification Search
USPC ..... 347/2, 4, 16, 104
See application file for complete search history.

(56) References Cited

U.S. PATENT DOCUMENTS

| | | | | |
|---|---|---|---|---|
| 6,854,843 | B2 * | 2/2005 | Anami et al. | 347/104 |
| 7,187,901 | B2 * | 3/2007 | Ohashi | 399/388 |
| 2007/0069457 | A1 * | 3/2007 | Terada | 271/272 |

FOREIGN PATENT DOCUMENTS

| | | |
|---|---|---|
| JP | 08-324054 | 12/1996 |
| JP | 2004-130774 | 4/2004 |
| JP | 2005-059584 | 3/2005 |

* cited by examiner

*Primary Examiner* — Julian Huffman
(74) *Attorney, Agent, or Firm* — Workman Nydegger

(57) ABSTRACT

A recording apparatus includes a recording unit, a discharge roller, a release mechanism, and a controller. The discharge roller is located downstream of the recording unit and includes a discharge driving roller and a discharge driven roller that apply a discharge force to the recording medium in a discharge direction. The release mechanism switches the discharge driven roller between a nip position, at which the discharge driven roller is brought into contact with the discharge driving roller when the recording medium is transported, and a release position, at which the discharge driven roller is spaced from the discharge driving roller when the holding tray is transported. The controller controls the transport roller, the discharge roller, and the release mechanism. The controller controls the discharge driving roller to be rotated a predetermined amount in the discharge direction before moving the discharge driven roller from the release position to the nip position.

4 Claims, 8 Drawing Sheets

RECORDING APPARATUS

BACKGROUND

1. Technical Field

The present invention relates to a recording apparatus including a transport roller that applies a transport force to each of a first soft recording medium such as plain paper, and the like and a holding tray in which a second hard recording medium such as a CD-R, or the like, is held, a recording unit that performs a desired recording onto the recording medium transported to a recording performing zone by the transport roller, a discharge roller that is located downstream of the recording unit and includes a discharge driving roller and a discharge driven roller that apply a discharge force to the first recording medium in a discharge direction.

2. Related Art

An ink jet printer will hereinafter be set forth as an exemplary recording apparatus. The ink jet printer may selectively perform recording onto both of a soft recording medium not having rigidity, such as paper, film, and the like, and a hard recording medium having rigidity, such as optical disks, for example, a CD-R, a DVD-R, or the like. When recording is performed onto the hard recording medium, a dedicated elongated holding tray that is provided as a separate accessory for the printer is used, or an ink jet printer in which a holding tray is incorporated in a main body of the printer as shown in JP-A-2005-59584 is used. The holding tray is provided with a set recess in which the recording medium such as a CD-R, or the like will be set.

When recording is performed onto the hard recording medium, a discharge driven roller of a discharge roller is at a release position spaced from a discharge driving roller.

The discharge driven roller, is located at the release position in the recording with the holding tray as described above, but is moved from the release position to a nip position when recording onto the soft recording medium such as plain paper. In the recording apparatus that incorporates the holding tray therein, the holding tray is moved from a set position to a received position to be withdrawn from a transport path that transports the soft recording medium such as plain paper, and the like, and then the discharge driven roller is moved from the release position to the nip position.

If a user mistakenly puts the hard recording medium such as a CD-R, or the like on the holding tray when the holding tray begins to move from the set position to the received position, the holding tray can move toward the received position with the hard recording medium deviated from the set recess.

In such a case, the holding tray may reach the predetermined received position, but the hard recording medium remains on the transport path. Then, the discharge driven roller moves from the release position to the nip position, so that the hard recording medium is pinched between the discharge driving roller and the discharge driven roller, thereby causing damage to the surface of the hard recording medium or difficulty in removing the pinched hard recording medium.

Otherwise, for the recording apparatus that does not incorporate the holding tray therein, the aforementioned problem also occurs in the event that a user mistakenly puts the hard recording medium such as a CD-R, or the like on the transport path just before the discharge driven roller is moved from the release position to the nip position.

SUMMARY

An advantage of some aspects of the invention is to provide a recording apparatus that may smoothly discharge a hard recording medium such as a CD-R, or the like outside a main body of the recording apparatus without carelessly damaging the hard recording medium.

In accordance with a first aspect of the invention, a recording apparatus includes: a transport roller that applies a transport force to each of a first recording medium and a holding tray in which a second recording medium is held; a recording unit that performs a desired recording onto the recording medium transported to a recording performing zone by the transport roller; a discharge roller that is located downstream of the recording unit and includes a discharge driving roller and a discharge driven roller that apply a discharge force to the first recording medium in a discharge direction; a release mechanism that switches the discharge driven roller between a nip position, at which the discharge driven roller is brought into contact with the discharge driving roller when the first recording medium is transported, and a release position, at which the discharge driven roller is spaced from the discharge driving roller when the holding tray is transported; and a controller that controls the transport roller, the discharge roller, and the release mechanism, wherein the controller controls the discharge driving roller to be rotated a predetermined amount in the discharge direction before moving the discharge driven roller from the release position to the nip position. Here, 'a predetermined amount' in "the discharge driving roller to be rotated a predetermined amount in the discharge direction" is a rotation amount that is needed to discharge the hard recording medium remaining on the transport path outside the apparatus. This is the same as in a recording apparatus relating to a second aspect of the invention below.

According to this aspect, even in the event that a hard recording medium remains on the transport path, the discharge driving roller is rotated a predetermined amount in the discharge direction before the discharge driven roller is moved from the release position to the nip position, thereby providing the following effect. Namely, before the discharge driven roller is moved from the release position to the nip position, the remaining hard recording medium is subjected to a discharge force caused by a contact friction force from the discharge driving roller that defines the transport path on its lower side, so that the remaining hard recording medium is smoothly discharged outside the apparatus main body. Therefore, it is possible to smoothly discharge the hard recording medium such as a CD-R, or the like outside the apparatus main body without carelessly damaging the hard recording medium.

In accordance with a second aspect of the invention, a recording apparatus includes: a holding tray that is incorporated in a main body of the recording apparatus and reciprocates between a received position and a set position; a transport roller that applies a transport force to each of a first recording medium and the holding tray in which a second recording medium is held; a recording unit that performs a desired recording onto the recording medium transported to a recording performing zone by the transport roller; a discharge roller that is located downstream of the recording unit and applies a discharge force to the first recording medium in a discharge direction; and a controller that controls the transport roller, the discharge roller and a release mechanism, wherein the controller controls the discharge roller to be rotated a predetermined amount in a discharge direction after reversing the transport roller to move the holding tray from a set position to the received position.

Here, the received position is a position at which the holding tray incorporated in the main body of the recording apparatus is located when not used. That is, the received position is located upstream of the transport roller inside the main body of the recording apparatus. When the holding tray is located at the received position, the transport path of the first soft recording medium such as paper, and the like is open to allow the first recording medium to be transported for recording. The set position is a position at which the holding tray is located when the second recording medium is set on the holding tray. In other words, the set position is located downstream of the transport roller in front of the main body of the recording apparatus.

According to this aspect, the controller controls the discharge roller to be rotated a predetermined amount in a discharge direction after reversing the transport roller to move the holding tray to the received position, so that even in the event that the hard recording medium remains on the transport path, the remaining hard recording medium is subjected to the discharge force from the discharge roller to be smoothly discharged outside the apparatus main body before transportation of the first recording medium begins for recording. Therefore, it is possible to prevent the first soft recording medium such as paper, and the like from being carelessly deformed.

When the apparatus includes the release mechanism of the first aspect, the controller controls the discharge roller to be rotated a predetermined amount in a discharge direction after reversing the transport roller to move the holding tray to the received position, so that even in the event that the hard recording medium remains on the transport path as the first aspect, the remaining hard recording medium is subjected to the discharge force from the discharge driving roller to be smoothly discharged outside the apparatus main body before the discharge roller begins to move from the release position to the nip position. Therefore, the apparatus may smoothly discharge a hard recording medium such as a CD-R, or the like outside the apparatus main body without carelessly damaging the hard recording medium.

A third aspect of the invention is a recording apparatus according to the second aspect, and comprises a supplementary transport mechanism that moves the holding tray between the received position and a position at which the transport force of the transport roller is applied to the holding tray, wherein the supplementary transport mechanism releases the power transmission to the supplementary transport mechanism when the discharge roller is rotated a predetermined amount in the discharge direction.

According to this aspect, the holding tray can be prevented from being moved in a transport direction which has no relation with the operation for discharging the hard recording medium remaining on the transport path outside the apparatus main body, thereby suppressing abrasion of the respective constituent members such as the holding tray or the guide arm connected to the holding tray, and the like.

A fourth aspect of the invention is a recording apparatus according to any one of the first to third aspects, wherein the discharge roller interlocks with the transport roller.

According to this aspect, a separate driving motor for rotating the discharge roller is not necessary, and it is possible to reduce the number of components, to reduce manufacturing cost, and to achieve a size and weight reduction of the apparatus through effective use of the driving motor for the transport roller.

In accordance with a fifth aspect of the invention, a recording apparatus includes: a holding tray that is incorporated in a main body of the recording apparatus and reciprocates between a received position and a set position; a transport roller that applies a transport force to each of a first recording medium and the holding tray in which a second recording medium is held; a recording unit that performs a desired recording onto the recording medium transported to a recording performing zone by the transport roller; a discharge roller that is located downstream of the recording unit and includes a discharge driving roller and a discharge driven roller that apply a discharge force to the first recording medium in a discharge direction; a release mechanism that switches the discharge driven roller between a nip position, at which the discharge driven roller is brought into contact with the discharge driving roller when the first recording medium is transported, and a release position, at which the discharge driven roller is spaced from the discharge driving roller when the holding tray is transported; a supplementary transport mechanism that moves the holding tray between the received position and a position at which the transport force of the transport roller is applied to the holding tray; and a controller that controls the transport roller, the discharge roller, the release mechanism, and the supplementary transport mechanism, wherein the discharge driving roller interlocks with the transport roller, and wherein, when a material to be discharged is located on a transport path, the controller allows the material to be extruded by operating the transport roller and the supplementary transport mechanism in a predetermined direction to move the holding tray to the received position, followed by operating the transport roller and the supplementary transport mechanism in a reverse direction to the predetermined direction.

According to this aspect, as the second aspect, even in the event that the hard recording medium remains on the transport path, the remaining hard recording medium is subjected to the discharge force from the discharge driving roller to be smoothly discharged outside the apparatus main body before the discharge driven roller begins to move from the release position to the nip position. In particular, according to this aspect, it is possible to use not only the friction force of the discharge driving roller but also the extrusion force of the holding tray as the discharge force to discharge the remaining hard recording medium, so that the hard recording medium may be reliably discharged outside the apparatus main body.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of a recording apparatus of the invention will be described. An ink jet printer will be described in brief as an exemplary embodiment of the recording apparatus of the invention with reference to the accompanying drawings.

Figure 1:
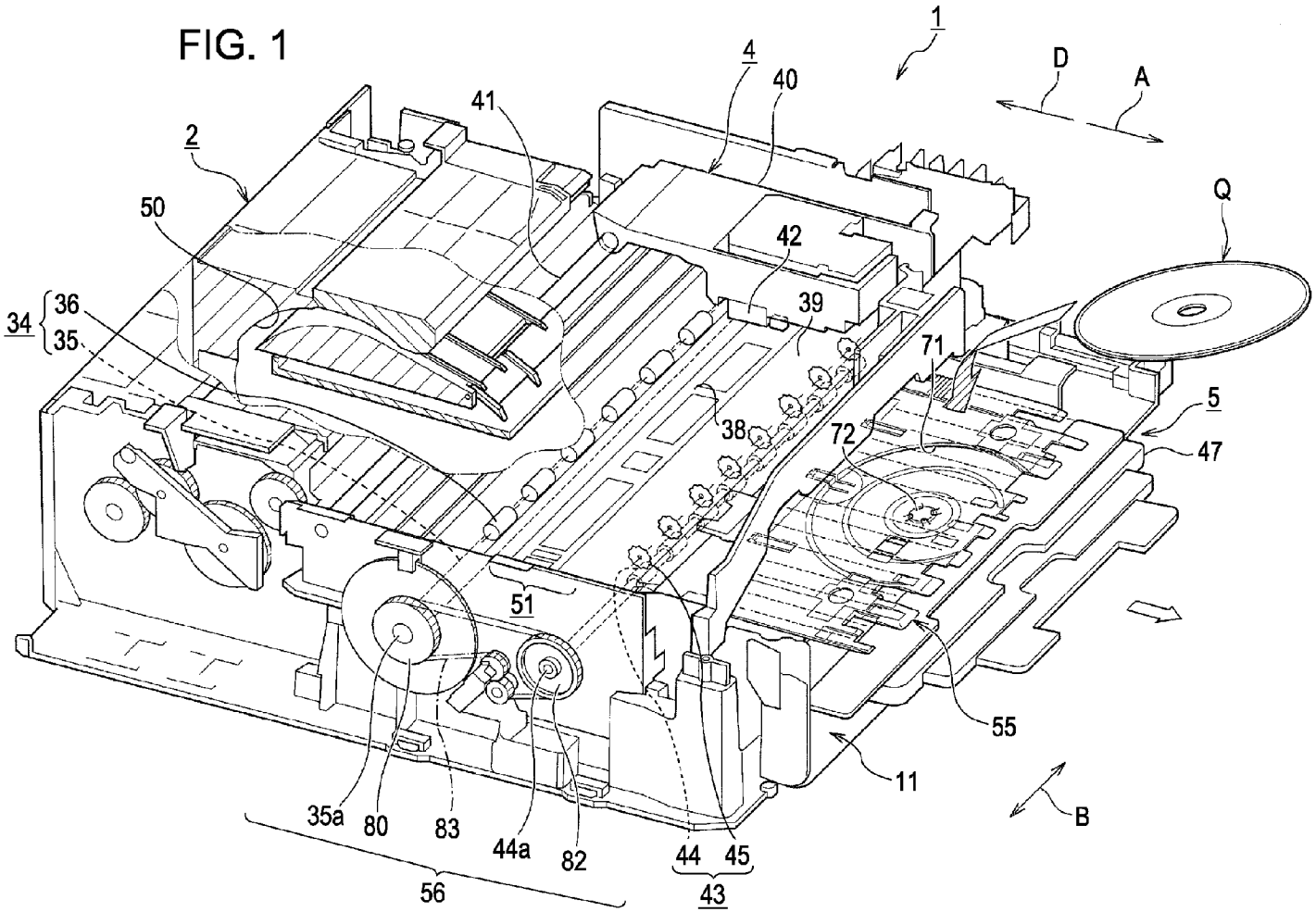
FIG. 1 is a perspective view showing an interior structure of an ink jet printer.
Figure 2:
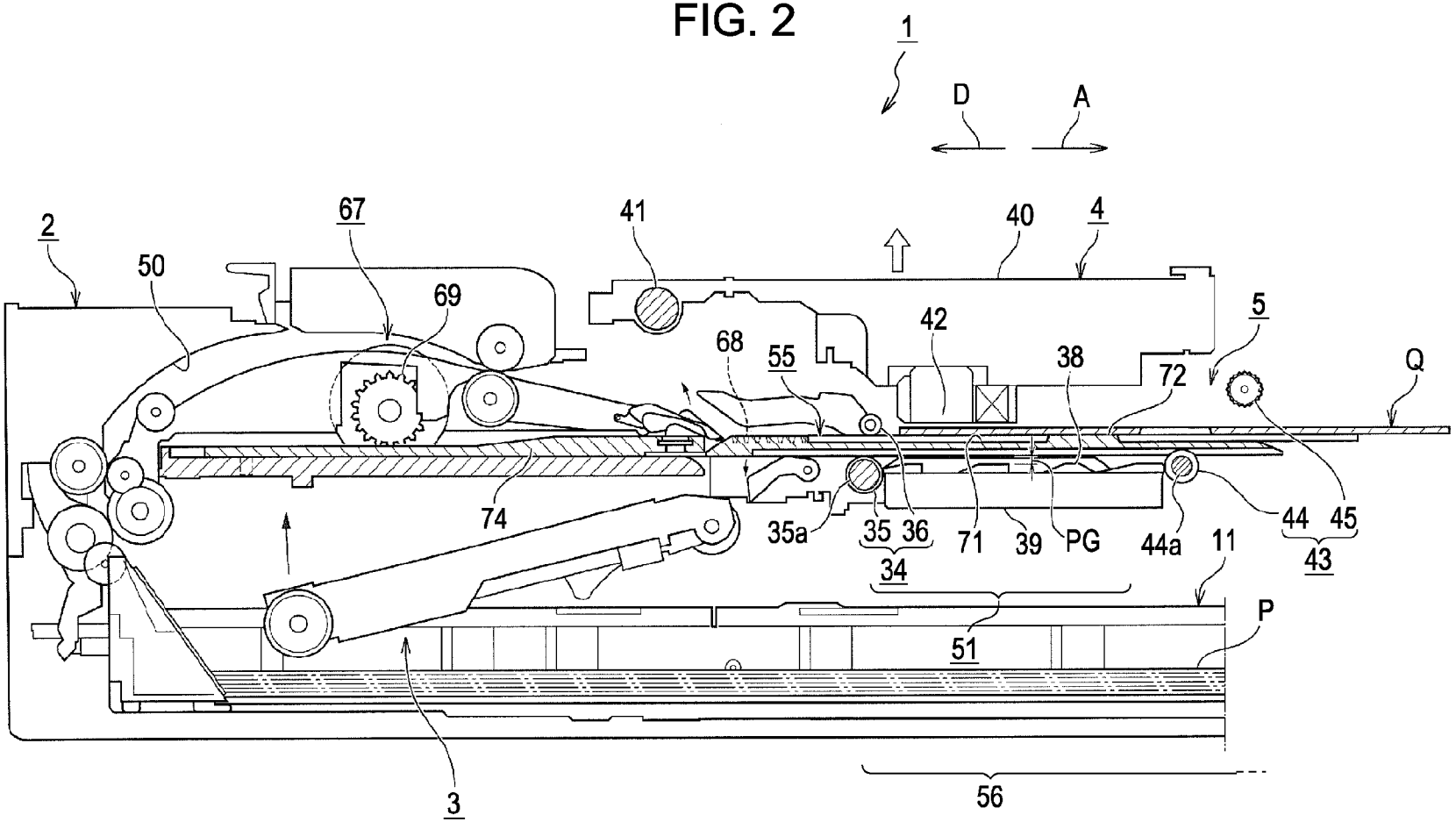
FIG. 2 is a side sectional view approximately showing the interior structure of the ink jet printer.

FIG. 1 is a perspective view showing an interior structure of an ink jet printer, and FIG. 2 is a side sectional view approximately showing the interior structure of the ink jet printer with a hard recording medium remaining on a transport path. The ink jet printer is a multiple function type ink jet printer that is provided at an upper portion thereof with an image reading apparatus (not shown), i.e., a scanner. The ink jet printer incorporates a holding tray therein and may perform recording onto both of a soft recording medium P, i.e., a first recording medium, such as paper, film, and the like, and a hard recording medium Q, i.e., a second recording medium, such as optical disks including a CD-R, a DVD-R, or the like.

The ink jet printer 1 includes a printer main body 2 that has a rectangular shaped case composed of relatively flat outer surfaces. A feed cassette 11 is detachably mounted on a front middle lower portion of the printer main body 2 to accommodate a number of the soft recording media P in a stacked state. The feed cassette 11 is provided at an upper portion thereof with a slide type stacker 47 that stacks the soft recording media P after recording is performed.

The feed cassette 11 is located at the start position of a transport path for the soft recording media P, and the soft recording media P accommodated in the feed cassette 11 are sequentially sent one by one from the uppermost sheet to a recording medium transport device 5 described below through a U-shaped reversal path 50 by a automatic feed apparatus 3. A terminal end of the U-shaped reversal path 50 is connected to a start end of a transport path 56 that guides the hard recording medium Q set in a holding tray 55 received in a space provided as a received position within the U-shaped reversal path 50 and the soft recording medium P fed through the U-shaped reversal path 50 to a recording performing zone 51 and the exterior of the printer main body 2.

The recording performing zone 51, is provided at a lower portion thereof with a transport guide 39 having a platen 38 that supports the lower side of the transported soft recording medium P to define a gap PG between the bottom of a recording head 42 and the lower side of the transported soft recording medium P. Meanwhile, the recording performing zone 51 is provided at an upper portion thereof with a recording unit 4, and the recording unit 4 is provided with a recording head 42 which discharges color inks through a nozzle opening formed in the lower side thereof, and with a carriage 40 which may be guided by a carriage guide shaft 41 with the recording head 42 mounted on the lower side thereof to reciprocate in a scan direction B crossing the transport direction A.

Embodiments

The structure of the ink jet printer 1 according to this embodiment will be described in detail with reference to the accompanying drawings.

Figure 3:
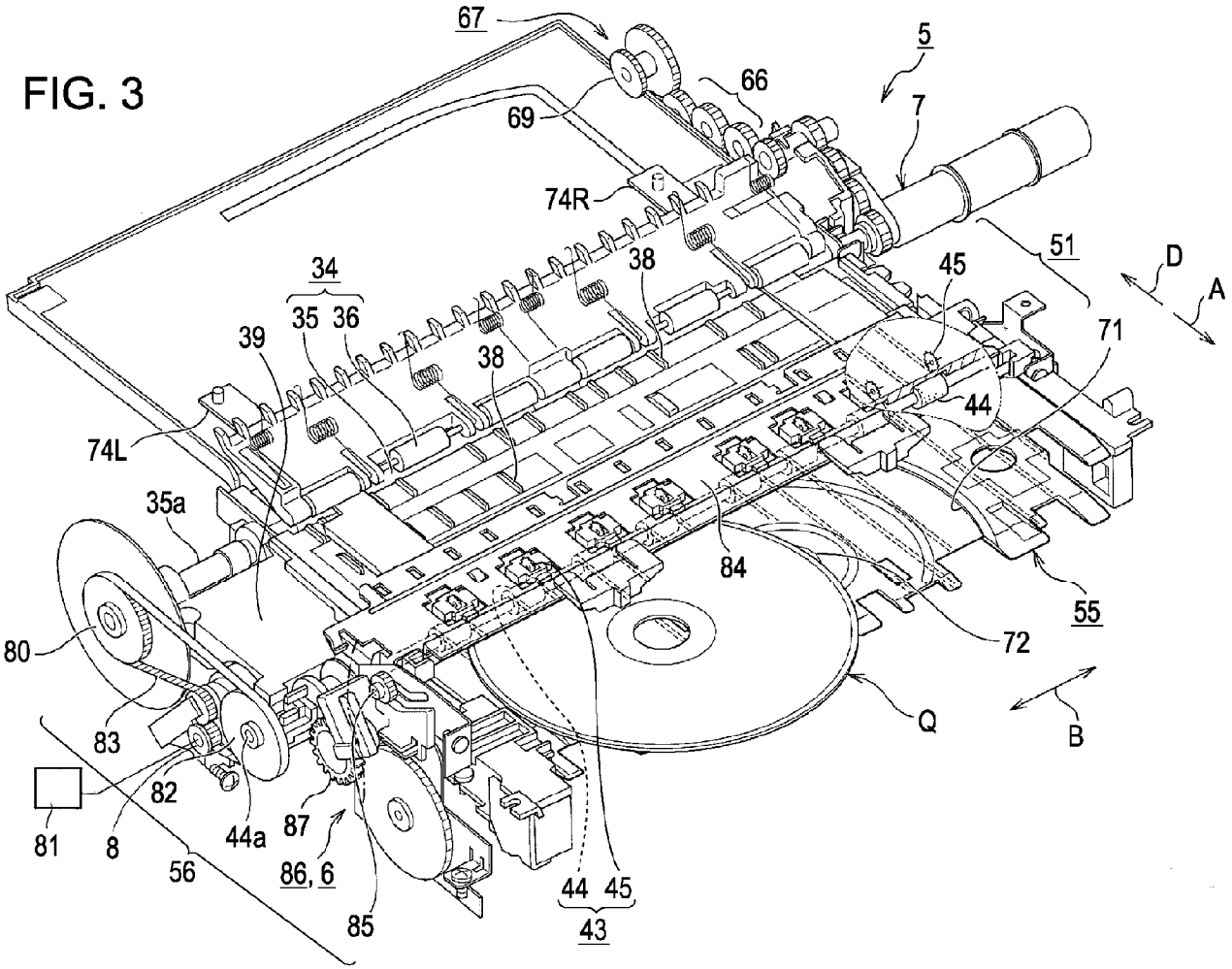
FIG. 3 is a perspective view showing a recording medium transport device when a holding tray is located at a set position.
Figure 4:
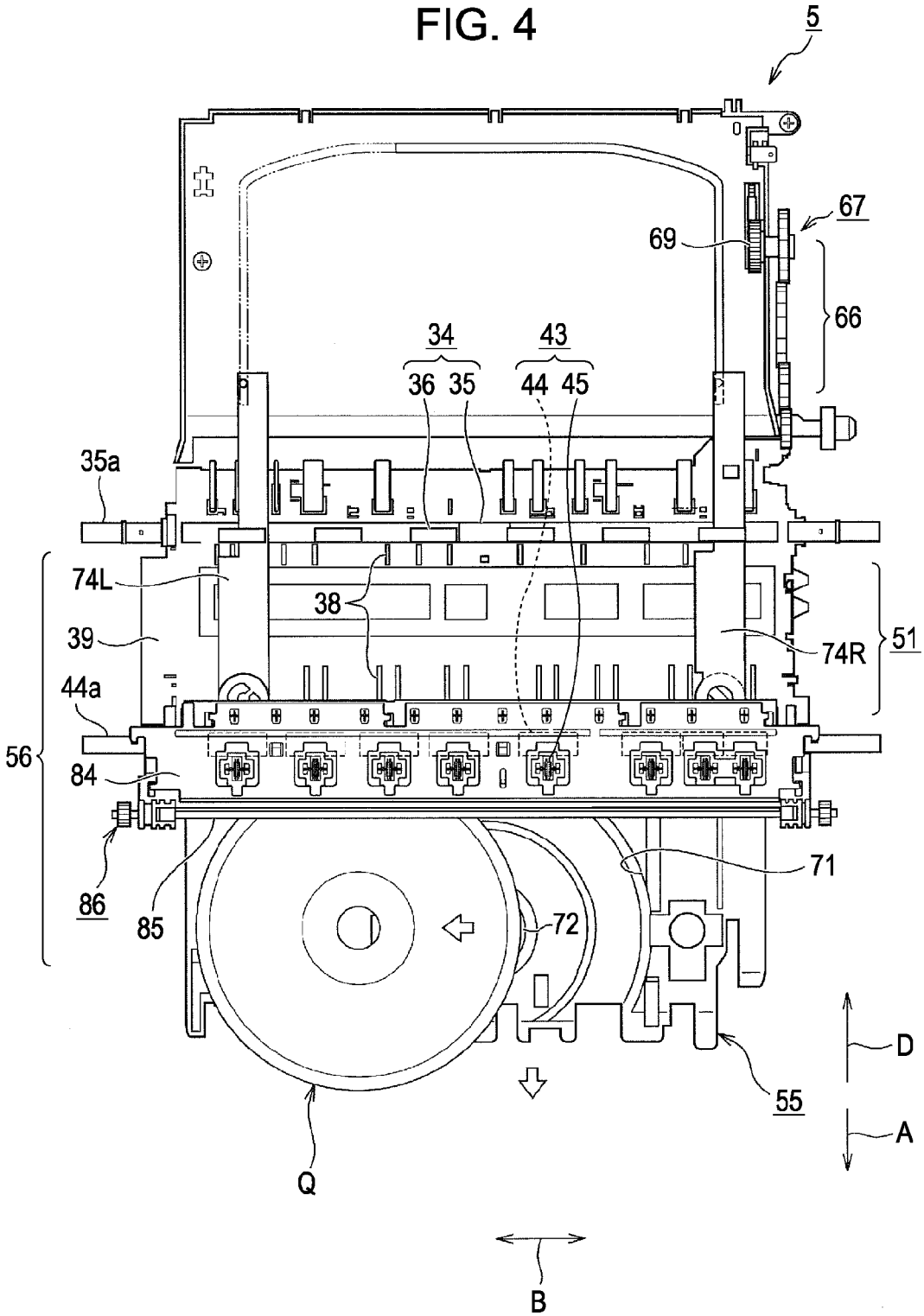
FIG. 4 is a plan view showing the recording medium transport device when a hard recording medium deviates.
Figure 5:
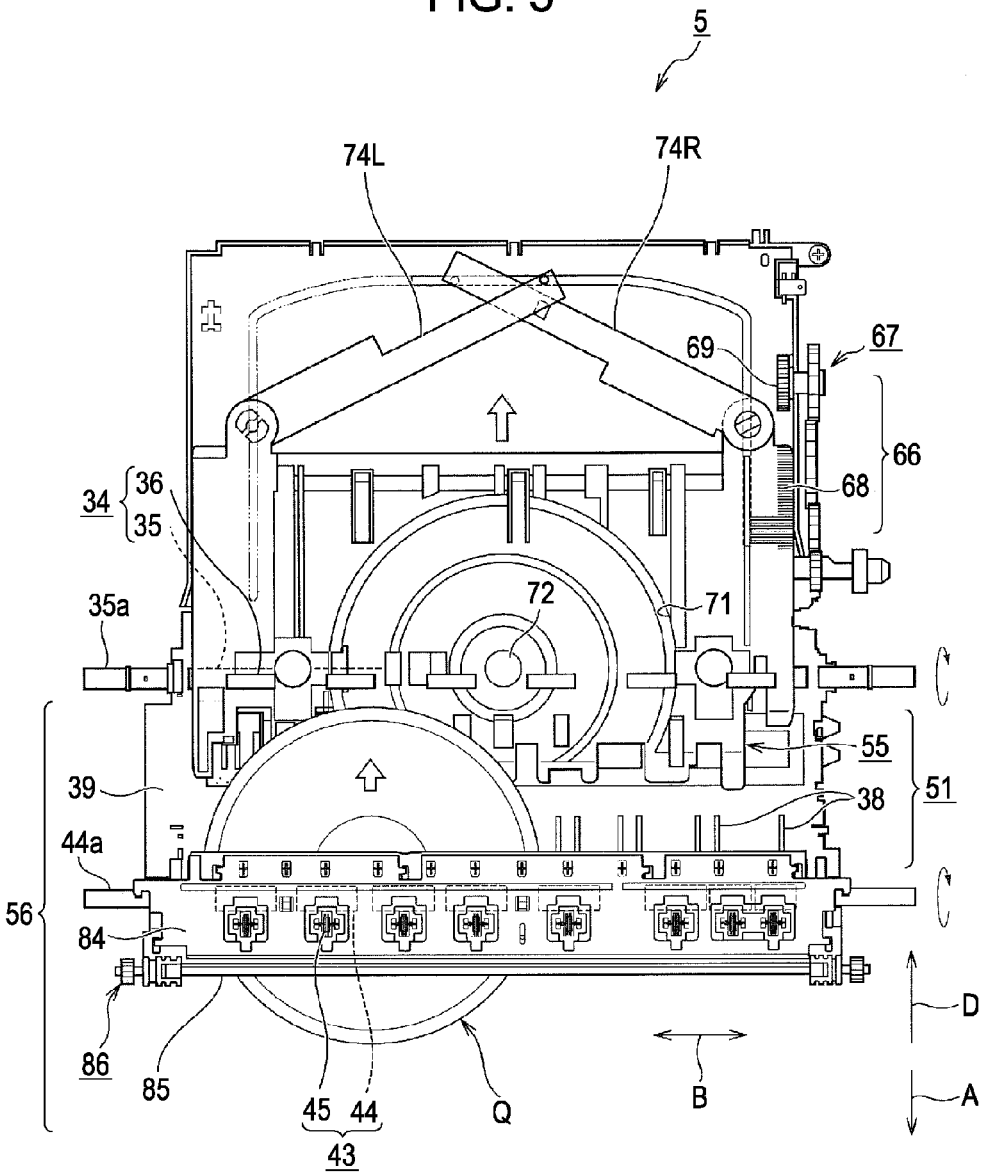
FIG. 5 is a plan view showing the recording medium transport device when a holding tray is moving.
Figure 6:
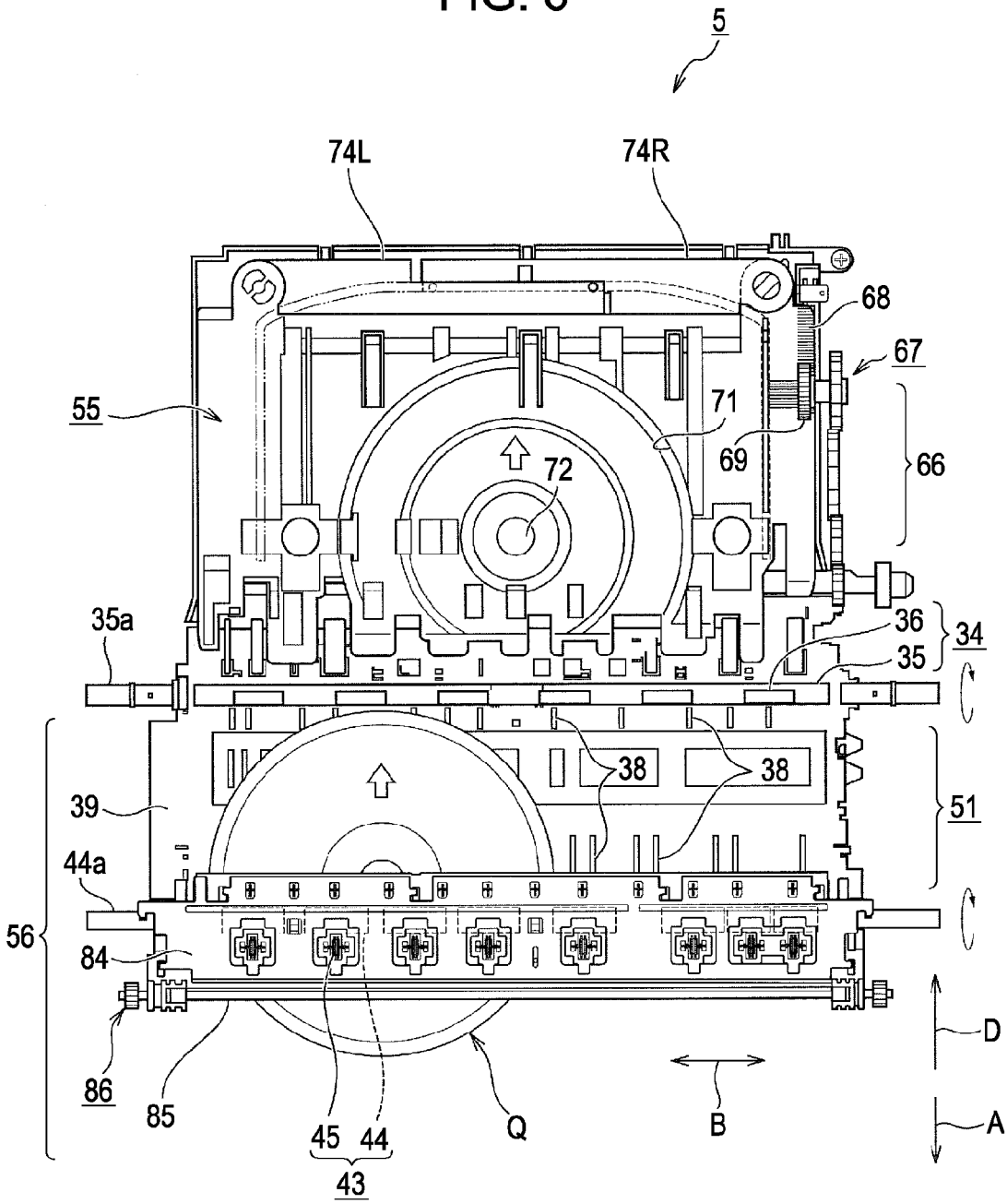
FIG. 6 is a plan view showing the recording medium transport device when a hard recording medium remains on a transport path.
Figure 7:
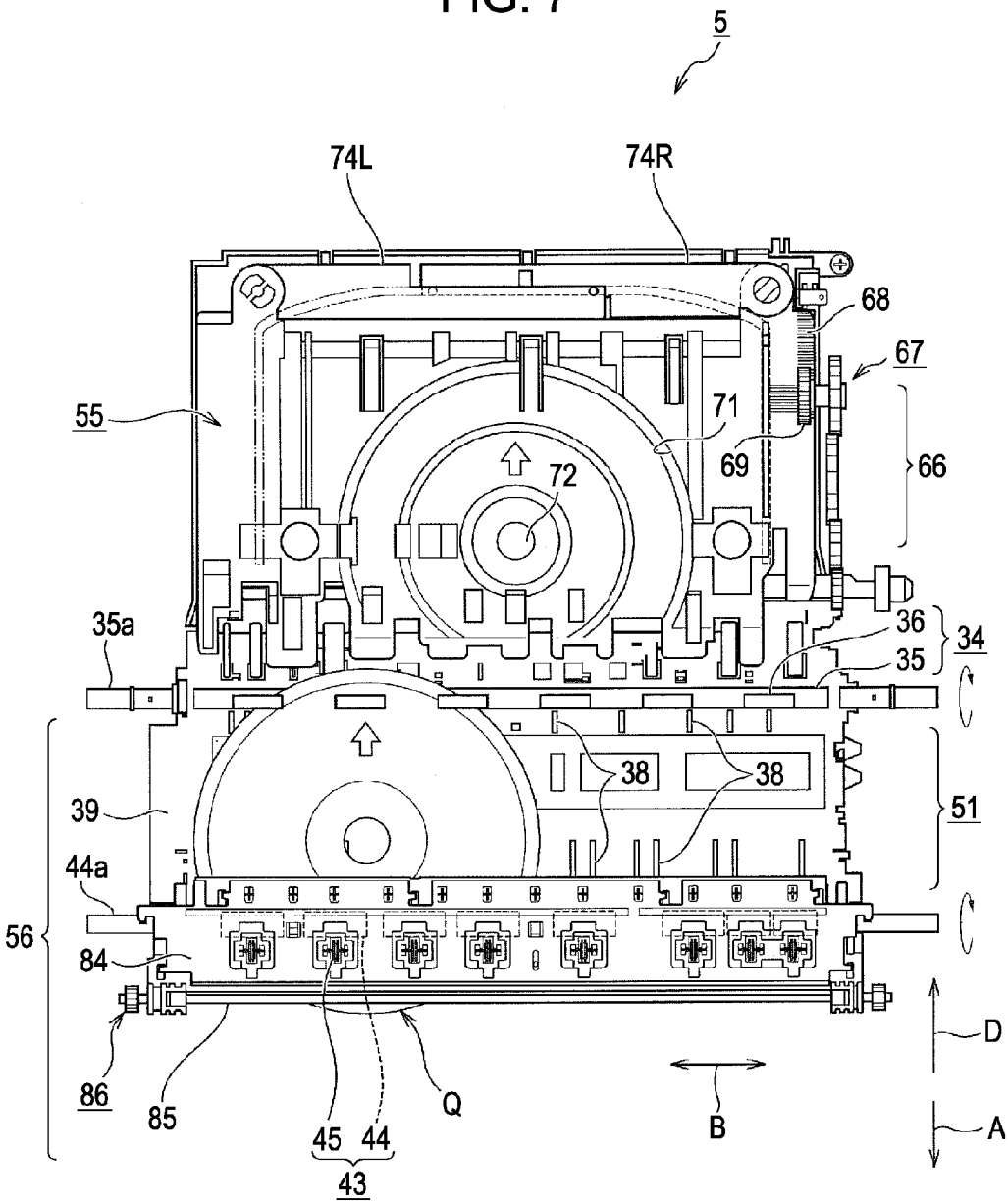
FIG. 7 is a plan view showing the recording medium transport device in another state in which a hard recording medium remains on a transport path.
Figure 8:
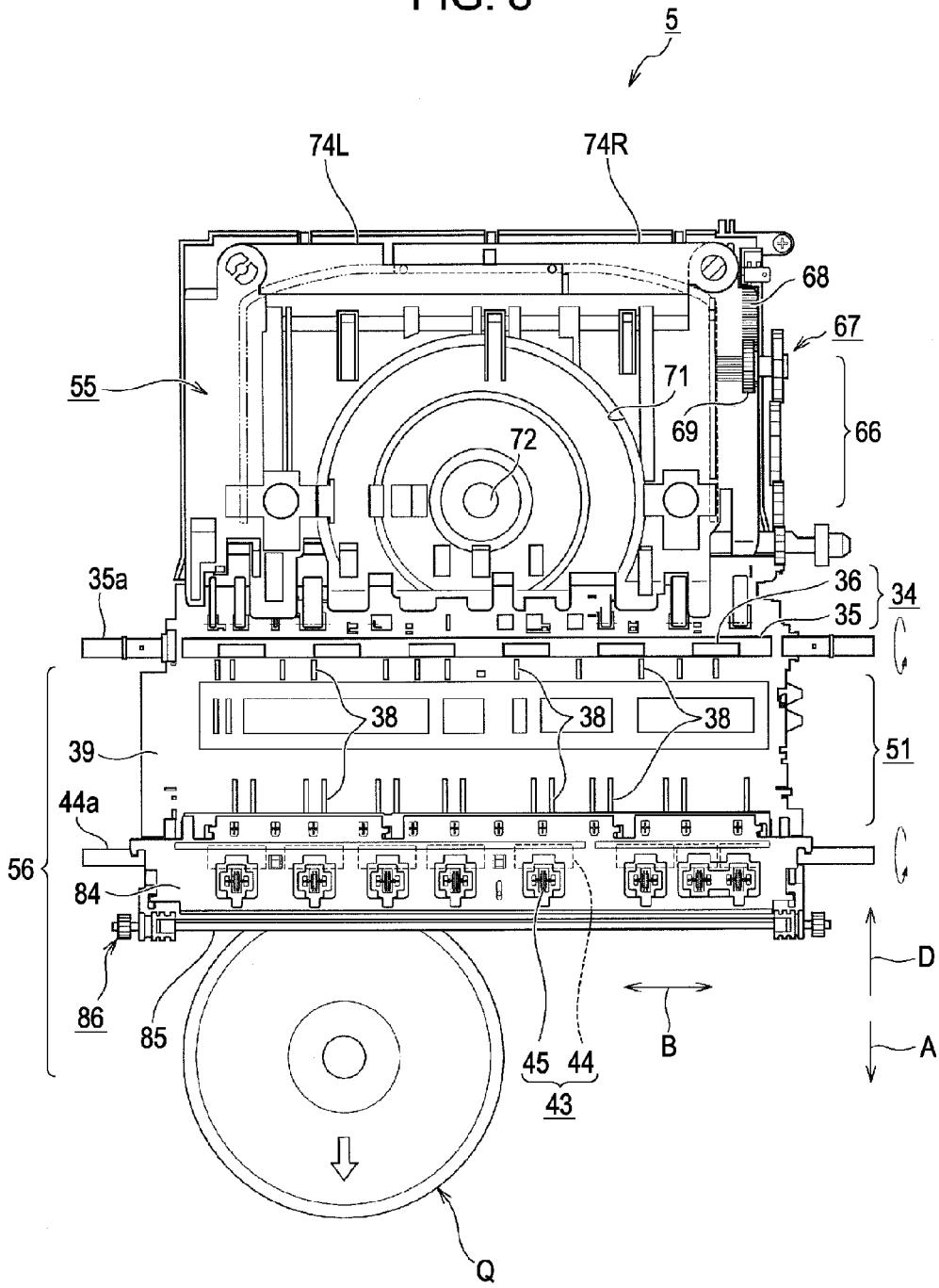
FIG. 8 is a plan view showing the recording medium transport device when a hard recording medium is being discharged.

FIG. 3 is a perspective view showing a recording medium transport device when a hard recording medium is being dislocated from a set recess in a state that a holding tray is located at a set position in the embodiment of the invention, FIG. 4 is a plan view showing the same state as FIG. 3 of the recording medium transport device, FIG. 5 is a plan view showing that the holding tray of the recording medium transport device is moving in the reverse direction, FIG. 6 is a plan view showing that the holding tray of the recording medium transport device is moved to a received position wherein the hard recording medium is located on a discharge driving roller of a transport path, FIG. 7 is a plan view showing that the holding tray of the recording medium transport device is moved to the received position wherein a portion of the hard recording medium is pinched by the transport roller, and FIG. 8 is a plan view showing that the hard recording medium remaining on the transport path of the recording medium transport device is discharged.

A recording medium transport device 5 of the ink jet printer of this embodiment includes the holding tray 55 incorporated in the printer main body 2 and having a set recess 71 formed to hold a hard recording medium Q; a transport roller 34 that includes a transport driving roller 35 and a transport driven roller 36 that pinch the hard recording medium Q together with the holding tray 55 or directly pinch the soft recording medium P to apply a transport force to the hard recording medium Q and the soft recording medium P in a transport direction A and a reversal direction D; a discharge roller 43 that includes a discharge driving roller 44 and a discharge driven roller 45 that pinch directly the soft recording medium P after recording to discharge it outside the printer main body 2; a release mechanism 6 that moves the discharge driven roller 45 between a nip position, at which the discharge driven roller 45 is brought into contact with the discharge driving roller 44 and a release position, at which the discharge driven roller 45 is spaced from the discharge driving roller 44; and a controller 81 that controls the transport roller 34, the discharge roller 43, and the release mechanism 6.

The holding tray 55 has a member having a shallow rectangular flat board shape. The holding tray 55 is provided with a set recess 71 to set the hard recording medium Q at a widthwise middle position slightly adjacent to the front side of the holding tray 55, and a zipper 72 to hold the hard recording medium Q set to the center of the holding tray 55. The hard recording medium Q that can be set to the holding tray 55 may be applicable to any available disk of, for example, 12 cm or 8 cm diameter including various optical disks such as a CD-R, a CD-RW, a DVD-R and a DVD-RW, blue ray disks that have attracted attention recently as next generation optical disks, disks that will be developed later, and the like.

The holding tray 55 has two guide arms 74L, 74R disposed near the left and right corners of a rear end thereof to expand a moving stroke of the shallow holding tray 55. In addition, the holding tray 55 has a lock 68 disposed near the rear right corner of an upper side thereof, as shown in FIGS. 5 to 7. The lock 68 engages with a pinion 69 that is placed facing at a nearby position to move the holding tray 55 located at the received position until it is transferred to the transport roller 34, and to move the holding tray 55 that is spaced from the nip position of the transport roller 34 until it is received at the received position.

Force for rotating the pinion 69 is obtained from the transport driving roller 35, wherein the rotation of the transport driving roller 35 is transmitted to a gear train 66 through a clutch mechanism 7 to rotate the pinion 69 at the terminal end of the gear train 66. The lock 68, pinion 69, clutch mechanism 7 and gear train 66 constitute a supplementary transport mechanism 67 that performs supplementary transport of the holding tray 55 between the received position and the nip position of the transport roller 34.

The transport roller 34 is constituted by a pair of nip rollers, that is, the transport driving roller 35 supported by a roller driving shaft 35*a*, which has a driving pulley 80 mounted at one end thereof and the clutch mechanism 7 mounted at the other end thereof and which is elongated in a width direction B (which is the same as symbol B indicating the scan direction), and a plurality of short transport driven rollers 36 disposed at an adequate interval in width direction B.

The discharge roller 43 includes the discharge driving roller 44 that is constituted by a plurality of short rubber rollers disposed at an adequate interval in width direction B on roller driving shaft 44*a*, and the discharge driven roller 45 that is constituted by disk-shape tooth rollers placed in a pair with the discharge driving roller 44. A driven pulley 82 is mounted at one end of the roller driving shaft 44*a*, and rotation of the transport driving roller 35 using a driving motor (only a pinion 8 is shown) as a power source is transmitted to the discharge driving roller 44 through a timing belt 83 wound between the driving pulley 80 and the driven pulley 82 to interlock with each other.

The release mechanism 6 is designed to switch the discharge driven roller 45 between a nip position, at which the discharge driven roller 45 is brought into contact with the discharge driving roller 44 when the soft recording medium P is transported, and a release position, at which the discharge driven roller 45 is spaced from the discharge driving roller 44 when the holding tray 55 is transported. Specifically, the release mechanism 6 includes a support frame 84 that supports the discharge driven roller 45 in a freely rotatable state, a support rod 85 that supports the support frame 84, and a position switch mechanism 86 using a cam mechanism and a slide guide mechanism that moves the support rod 85 together with the discharge driven roller 45 between the nip position and the release position described below in a state where the posture of the support frame 84 is maintained horizontally.

The controller 81 controls the discharge driving roller 45 to be rotated a predetermined amount in a discharge direction before the discharge driven roller 45 is moved from the release position to the nip position. Therefore, when a hard recording medium Q remains on a transport path 56 in a state of being deviated from the set recess 71 of the holding tray 55, the controller 81 allows the hard recording medium Q remaining on the transport path 56 to be discharged outside the printer main body 2 by releasing the power transmission to the holding tray 55 through the clutch mechanism 7 and then by rotating the transport driving roller 35 and the discharge driving roller 44 in the transport direction A, i.e., in the discharge direction.

Specifically, the hard recording medium Q is discharged outside the printer main body 2 by rotating the transport driving roller 35 in the transport direction A while rotating the discharge driving roller 44 in the discharge direction via the timing belt 83, and by a discharge force caused by friction force between the discharge driving roller 44 and the lower side of the hard recording medium Q contacting the discharge driving roller 44.

Further, as shown in FIG. 7, when a portion of the hard recording medium Q is pinched by the transport roller 34 in a state of being deviated from the set recess 71 of the holding tray 55, the hard recording medium Q may be extruded and discharged outside the printer main body 2 by rotating the transport roller 34 in the transport direction A. In addition, after the hard recording medium Q is moved to the position unaffected by the transport force of the transport roller 34, the hard recording medium Q is subjected to the discharge force of the discharge driving roller 44 to be securely discharged outside the printer main body 2.

Next, the operation of the recording apparatus of the embodiment constituted as the above will be described.

The operation of the recording apparatus of the embodiment will be described with three processes, i.e., (1) a process for receiving the holding tray, (2) a process for discharging the recording medium, and (3) a process for moving the discharge driven roller. The process for discharging the recording medium is performed after the process for receiving the holding tray and before the process for moving the discharge driven roller.

(1) A Process for Receiving the Holding Tray (See FIGS. 4, 5, 6 and 7)

The process for receiving the holding tray is performed to move the holding tray 55 located at the set position to the received position. For example, as shown in FIG. 4, when the hard recording medium Q is located on the holding tray 55 immediately before beginning to move toward the received position in a state of being deviated from the set recess 71 in the width direction B due to the user's inappropriate handling, the process is as below.

As shown in FIG. 4, the holding tray 55 begins to move toward the received position by being pulled toward the depth portion by the guide arms 74L, 74R that are pinched by the transport roller 34. When the holding tray 55 moves, as shown in FIG. 5, the transport roller 34 continues to move toward the received position by directly pinching the holding tray 55. However, the hard recording medium Q remains on the transport path 56 as shown.

Even in a state where the holding tray 55 reaches the received position as shown in FIGS. 6 and 7, the hard recording medium Q remains on the transport path 56 and stops on the discharge driving roller 44 as shown in FIG. 6. Otherwise, the holding tray 55 is pulled further toward the depth portion, and a portion of the hard recording medium Q is stopped in a state of being pinched by the transport roller 34 as shown FIG. 7.

(2) A Process for Discharging the Recording Medium (See FIG. 8)

The process for discharging the recording medium is performed to rotate the discharge driving roller 44 a predetermined amount in the discharge direction before the discharge driven roller 45 is moved from the release position to the nip position. Specifically, this process rotates the transport driving roller 35 in the transport direction A, i.e., the discharge direction by changing the rotation direction of the driving motor. The rotation of the transport driving roller 35 is transmitted to the roller driving shaft 44*a* via the timing belt 83 to rotate the discharge driving roller 44 in the discharge direction. Here, rotation of the roller driving shaft 44*a* is not transmitted to a transmission gear 87 and the discharge driven roller 45 waits at the release position (see FIG. 2).

The hard recording medium Q remaining on the transport path 56 is discharged outside the printer main body 2 as shown by the discharge force caused by the friction force of the discharge driving roller 44. In a state of FIG. 7, the hard recording medium Q remaining on the transport path 56 also subjected to extrusion by the transport roller 34 is discharged outside the printer main body 2.

In the embodiment, when the transport driving roller 35 is rotated in the discharge direction, the power transmission to the pinion 69 is released by the clutch mechanism 7, so that the holding tray 55 is prevented from being moved in a transport direction which has no relation with the operation to discharge the hard recording medium Q remaining on the transport path 56 outside the apparatus main body. Therefore, it is possible to suppress abrasion of the respective constituent members such as the holding tray 55 or the guide arm 74 connected to the holding tray 55, and the like.

(3) A Process for Moving the Discharge Driven Roller (See FIGS. 1 to 3)

The process for moving the discharge driven roller is performed to move the discharge driven roller 45 located at the release position (see FIG. 2) to the nip position (see FIGS. 1 and 3) after the holding tray 55 is moved to the received position. Namely, this process transmits the rotation of the discharge driving roller 44 to the position switch mechanism 86 via the transmission gear 87 by operating the release mechanism 6. As a result, the support rod 85 and the discharge driven roller 45 located at the release position together with the support frame 84 are moved in a downwardly inclined direction and toward the depth portion, and then to the nip position at which the discharge driven roller 45 is brought into contact with the outer circumference surface of the discharge driving roller 44.

According to the embodiment, the operation to rotate the discharge driving roller 44 a predetermined amount in the discharge direction is performed before the discharge driven roller 45 is moved to the nip position, so that, if the hard recording medium Q remains on the transport path 56 due to the user's mistaken handling, the remaining hard recording medium is subjected to the discharge force from the discharge driving roller to be discharged outside the apparatus main body. Therefore, it is possible to smoothly discharge the hard recording medium such as a CD-R, or the like outside the apparatus main body without carelessly damaging the hard recording medium.

The operations of the processes (1) to (3) are performed even in the event that there is no inappropriate handling by the user and the hard recording medium is not located on the holding tray 55.

Other Embodiments

The recording apparatus 1 according to the invention basically has the afore-mentioned structure, but it is possible to modify or omit a portion of the structure without departing from the scope of the invention.

For example, the invention is not limited to the case that the hard recording medium Q is deviated in the width direction B, thus it is possible to obtain the same effect as the above and to discharge the hard recording medium Q outside the main body 2 even in the event that there is a deviation in the transport direction A.

In the above embodiment, the recording apparatus having the release mechanism is described, but a recording apparatus not having the release mechanism may obtain useful effects by being constituted as the below. Namely, in this embodiment, the controller 81 reverses the transport roller 34 to move the holding tray 55 to the received position, and then rotates the discharge roller 43 a predetermined amount in the discharge direction. By this, even in the event that the hard recording medium Q remains on the transport path, the remaining hard recording medium Q is subjected to the discharge force from the discharge roller 43 to be smoothly discharged outside the apparatus main body before beginning the transport operation to record onto the first soft recording medium P, such as paper, and the like. Therefore, the occurrence of the problem that the first soft recording medium P such as paper, and the like is carelessly deformed, may be reduced.

Also, it is possible to omit the clutch mechanism 7 provided in the embodiment. Namely, when the hard recording medium Q is located on the transport path 56, the controller 81 allows the hard recording medium Q to be extruded by the holding tray 55 by operating the transport roller 34 and the supplementary transport mechanism 67 in a predetermined direction to move the holding tray 55 to the received position, followed by operating the transport roller 34 and the supplementary transport mechanism 67 in a reverse direction to the predetermined direction.

According to the embodiment, even in the event that the hard recording medium Q remains on the transport path 56, it is possible to use not only the friction force of the discharge driving roller 44 but the extrusion force of the holding tray 55 as the discharge force to discharge the remaining hard recording medium Q, so that the hard recording medium Q is reliably discharged outside the apparatus main body before the discharge driven roller 45 is moved from the release position to the nip position.

In addition, it is possible to configure the discharge driving roller 44 to be detached from the transport driving roller 35 and to be independently rotatable. In this case, even if the clutch mechanism 7 provided in the embodiment is omitted, movement of the holding tray 55 is prevented during the discharging of the hard recording medium Q.

What is claimed is:

1. A recording apparatus comprising:

a transport roller that applies a transport force to each of a first recording medium and a holding tray in which a second recording medium is held;

a recording unit that performs a desired recording onto the recording medium transported to a recording performing zone by the transport roller;

a discharge roller that is located downstream of the recording unit and includes a discharge driving roller and a discharge driven roller that apply a discharge force to the first recording medium in a discharge direction;

a release mechanism that switches the discharge driven roller between a nip position, at which the discharge driven roller is brought into contact with the discharge driving roller when the first recording medium is transported, and a release position, at which the discharge driven roller is spaced from the discharge driving roller when the holding tray is transported; and a controller that controls the transport roller, the discharge roller, and the release mechanism, wherein the controller controls the discharge driving roller to be rotated a predetermined amount in the discharge direction, while the discharge roller is in the release position before moving the discharge driven roller from the release position to the nip position, and when the discharge driving roller is rotated the predetermined amount in the discharge direction, the controller controls the holding tray to prevent the holding tray from moving in a transport direction.

2. The recording apparatus to claim 1, wherein the discharge roller interlocks with the transport roller.

3. A recording apparatus comprising:

a holding tray that is incorporated in a main body of the recording apparatus and reciprocates between a received position and a set position;

a transport roller that applies a transport force to each of a first recording medium and the holding tray in which a second recording medium is held;

a recording unit that performs a desired recording onto the recording medium transported to a recording performing zone by the transport roller;

a discharge roller that is located downstream of the recording unit and applies a discharge force to the first recording medium in a discharge direction; and a controller that controls the transport roller, the discharge roller and a release mechanism, wherein the release mechanism switches the discharge roller between a nip position and a release position, wherein the controller controls the discharge roller to be rotated a predetermined amount, while the discharge roller is in the release position, in a discharge direction after reversing the transport roller to move the holding tray from a set position to the received position, and when the discharge driving roller is rotated the predetermined amount in the discharge direction, the controller controls the holding tray to prevent the holding tray from moving in a transport direction.

4. The recording apparatus to claim 3, further comprising:

a supplementary transport mechanism that moves the holding tray between the received position and a position at which the transport force of the transport roller is applied to the holding tray, wherein the supplementary transport mechanism releases the power transmission to the supplementary transport mechanism when the discharge roller is rotated a predetermined amount in the discharge direction.

* * * * *